US007654506B1

(12) United States Patent
Tai

(10) Patent No.: US 7,654,506 B1
(45) Date of Patent: Feb. 2, 2010

(54) STAIRWAY HANDRAIL

(76) Inventor: Chi-Chiang Tai, 3F.-5, No. 262, Sec. 2, Henan Rd., Situn District, Taichung City 407 (TW)

( * ) Notice: Subject to any disclaimer, the term of this patent is extended or adjusted under 35 U.S.C. 154(b) by 0 days.

(21) Appl. No.: 12/488,568

(22) Filed: Jun. 21, 2009

(51) Int. Cl.
*E04H 17/14* (2006.01)

(52) U.S. Cl. ..... 256/67

(58) Field of Classification Search ..... 256/67
See application file for complete search history.

(56) References Cited

U.S. PATENT DOCUMENTS 4,150,907 A * 4/1979 Thurnauer ..... 256/67
4,421,302 A * 12/1983 Grimm et al. ..... 256/67
4,923,176 A * 5/1990 Heinz ..... 256/65.06
5,547,169 A * 8/1996 Russell ..... 256/67
5,653,546 A * 8/1997 Cronkhite et al. ..... 256/67
6,698,726 B2 * 3/2004 Platt ..... 256/67
2003/0193049 A1 * 10/2003 Kim ..... 256/67
2007/0145343 A1 * 6/2007 Lehmann ..... 256/67
2009/0200532 A1 * 8/2009 Platt ..... 256/67

* cited by examiner

*Primary Examiner*—Victor MacArthur
(74) *Attorney, Agent, or Firm*—Banger Shia

(57) ABSTRACT

The stairway handrail of the present invention includes first, second rail bodies, a substantially cylindrical joint, and a first connecting element. The first, second rail bodies can engage with the joint, and the joint has a central axis and a longitudinal slot radially disposed from the pivot portion to the joint surface of the joint. The first connecting element is disposed in the longitudinal slot, and it has a pivot end pivotably disposed in the pivot portion and a connecting end fixed on the first rail body. Thereby, the first rail body is rotatable about the central axis to adjust the included angle between first and second rail bodies.

9 Claims, 6 Drawing Sheets

STAIRWAY HANDRAIL

BACKGROUND OF THE INVENTION

1. Field of the Invention

The present invention relates to a stairway handrail in which an angle between two rail bodies can be quickly and conveniently adjusted.

2. Description of the Prior Art

Stairway handrails are one of the greatest inventions of human beings. They are not merely armrests for people who go up or down stairs, but they also prevent people from accidentally falling. Therefore, stairway handrails are indispensible device for modern buildings. In addition to the practical usability, they also have decorative value.

Generally, it takes repeatedly distance, height, and angle measurements to install a stairway handrail, as a result the construction level is highly required, especially for turns of the stairway handrail. There are both horizontal and vertical drops at the turns, as well as the included angles between rail bodies, thus making them the most complicate and time-consuming part of the stairway handrail construction.

Some joint structures for the turns are therefore provided to simplify the construction process, as shown in the Taiwanese patent no. M341725. This patent provides two assemble units and a joint, in which the joint has two stationarily disposed threaded rods with fixed angle formed therebetween, thereby the assemble units are jointed together. Due to the un-adjustable angle between the threaded rods, such joint structure can not be applied to stairways with different slopes.

As taught in the Taiwanese patents no. M261545 and M314227, they mainly provide a universal joint between two rail bodies to quickly adjust the included angle of rail bodies. Nevertheless, the universal joint is exposed between the rail bodies after construction, which leads to odd and discontinuous appearance at the turns.

SUMMARY OF THE INVENTION

A main object of the present invention is to provide a stairway handrail in which the included angel of two rail bodies is adjustable.

Another main object of the present invention is to provide a stairway handrail in which the pivot structure thereof is not exposed to the surroundings.

To achieve the above and other objects, the stairway handrail of the present invention includes first, second rail bodies, a substantially cylindrical joint, and a first connecting element. The first, second rail bodies can engage with the joint, and the joint has a central axis and a longitudinal slot radially disposed from the pivot portion to the joint surface of the joint. The first connecting element is disposed in the longitudinal slot, and it has a pivot end pivotably disposed in the pivot portion and a connecting end fixed on the first rail body. Thereby, the first rail body is rotatable about the central axis to adjust the included angle between first and second rail bodies.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
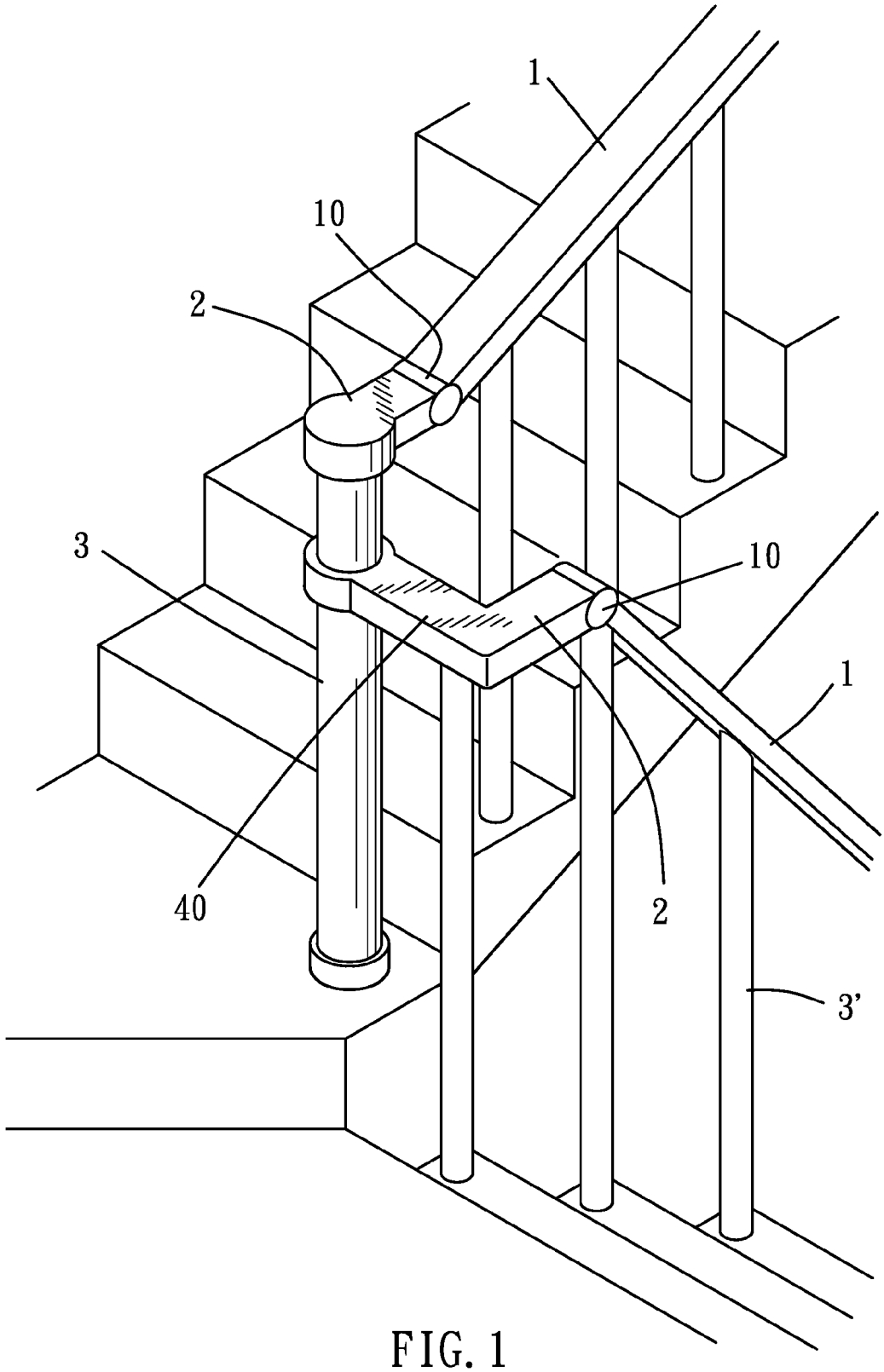
FIG. 1 is a drawing showing a stairway handrail of the present invention being installed in a stairway.
Figure 2:
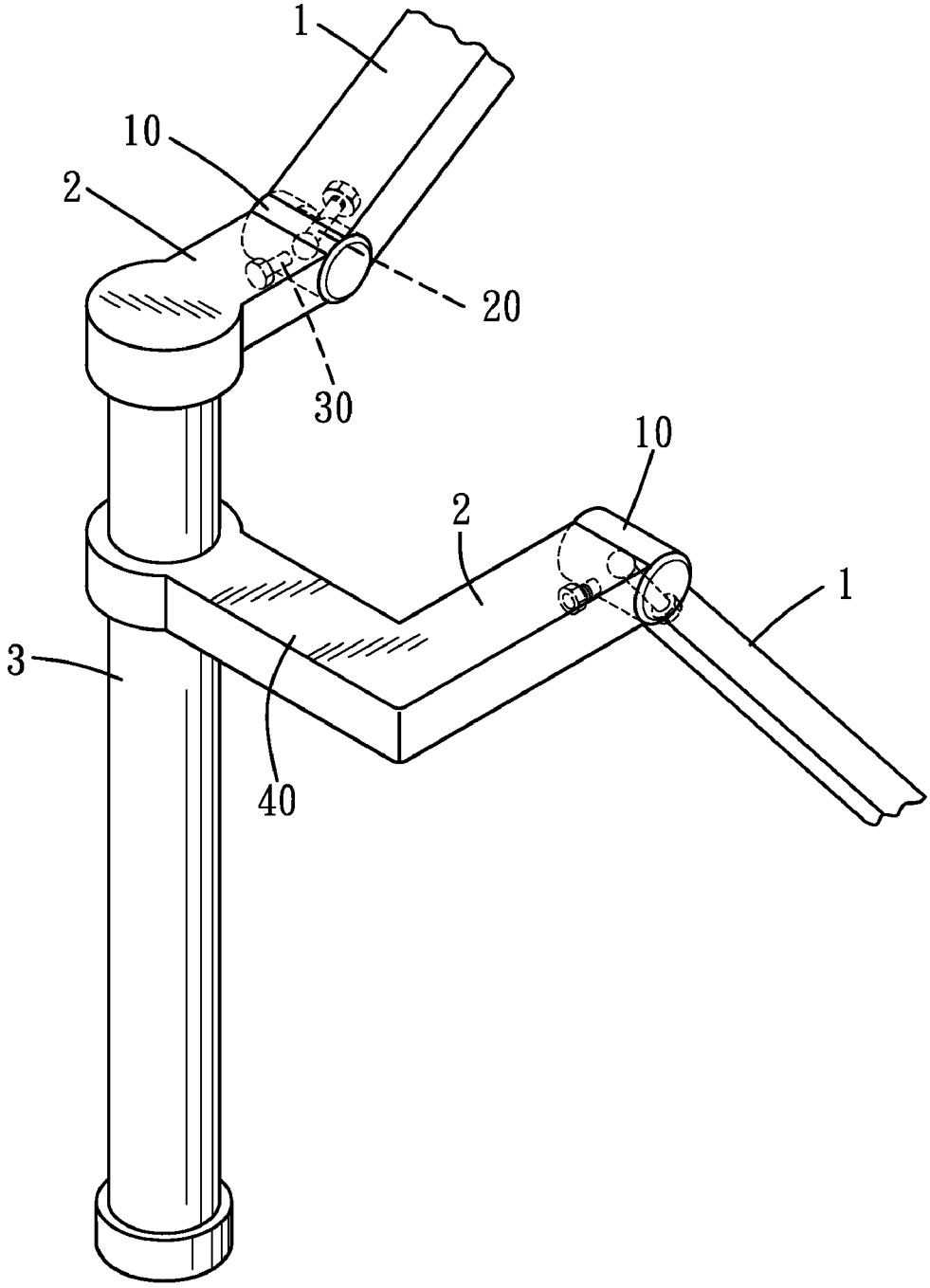
FIG. 2 is a combination drawing showing a stairway handrail of the present invention.

Please refer to FIG. 1 and FIG. 2. A stairway handrail of the present invention includes a first rail body 1, a second rail body 2, a substantially cylindrical joint 10, a first connecting element 20, a second connecting element 30, multiple stanchions 3, 3' and a connecting member 40. It is to be noted that the first and second rail bodies 1, 2 are literally distinguished from each other for illustrative purpose only. In practical, the terms "first" and "second" hereinafter do not mean to indicate any specific types or forms of rail bodies. The stanchions 3, 3' are used to support the rail bodies, while the stanchion 3 is disposed at the turns of the stairway and thus is specifically marked off.

Figure 3:
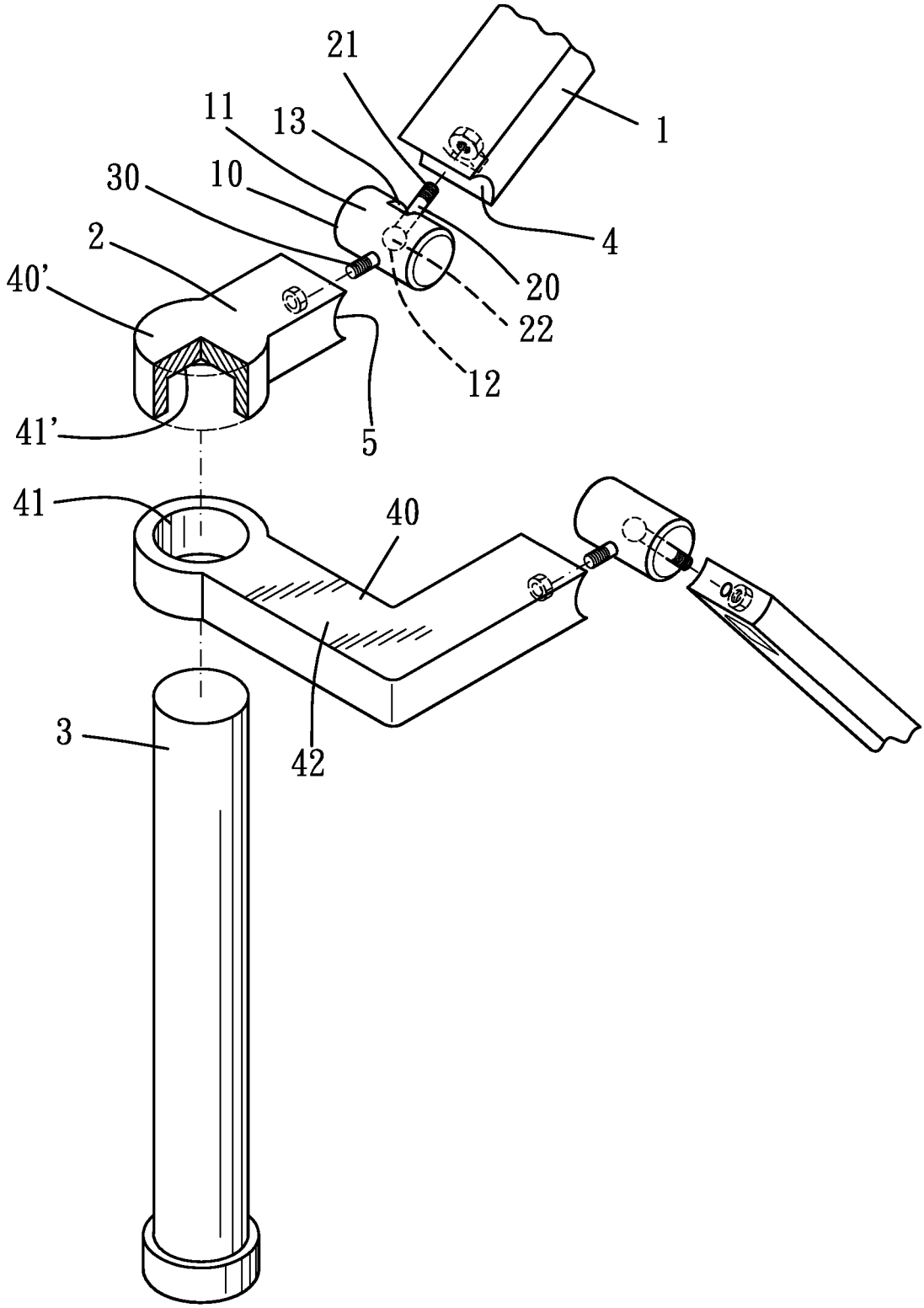
FIG. 3 is an explosive drawing showing a stairway handrail of the present invention.
Figure 4:
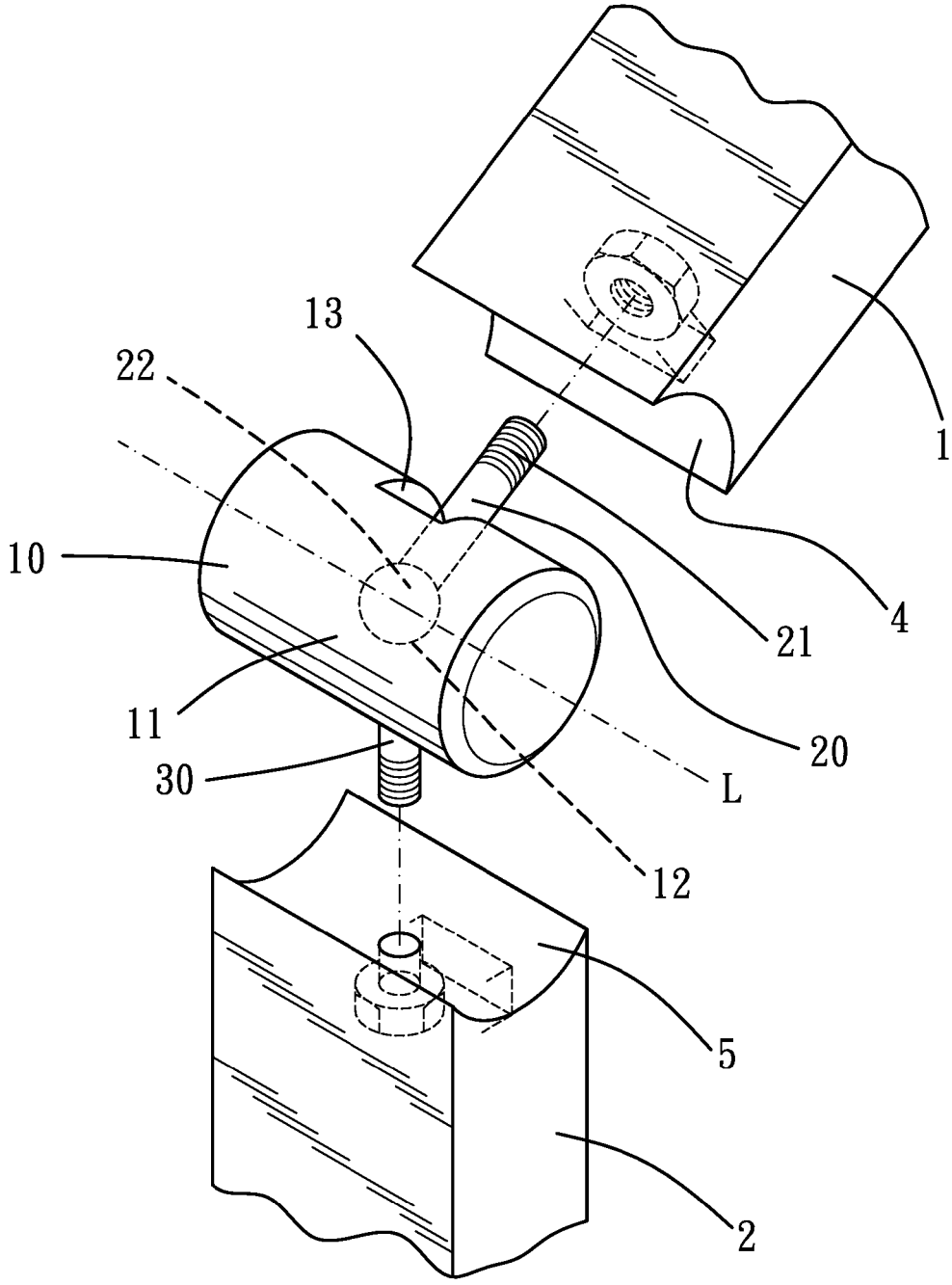
FIG. 4 is an explosive drawing showing a joint and rail bodies of the present invention.
Figure 5:
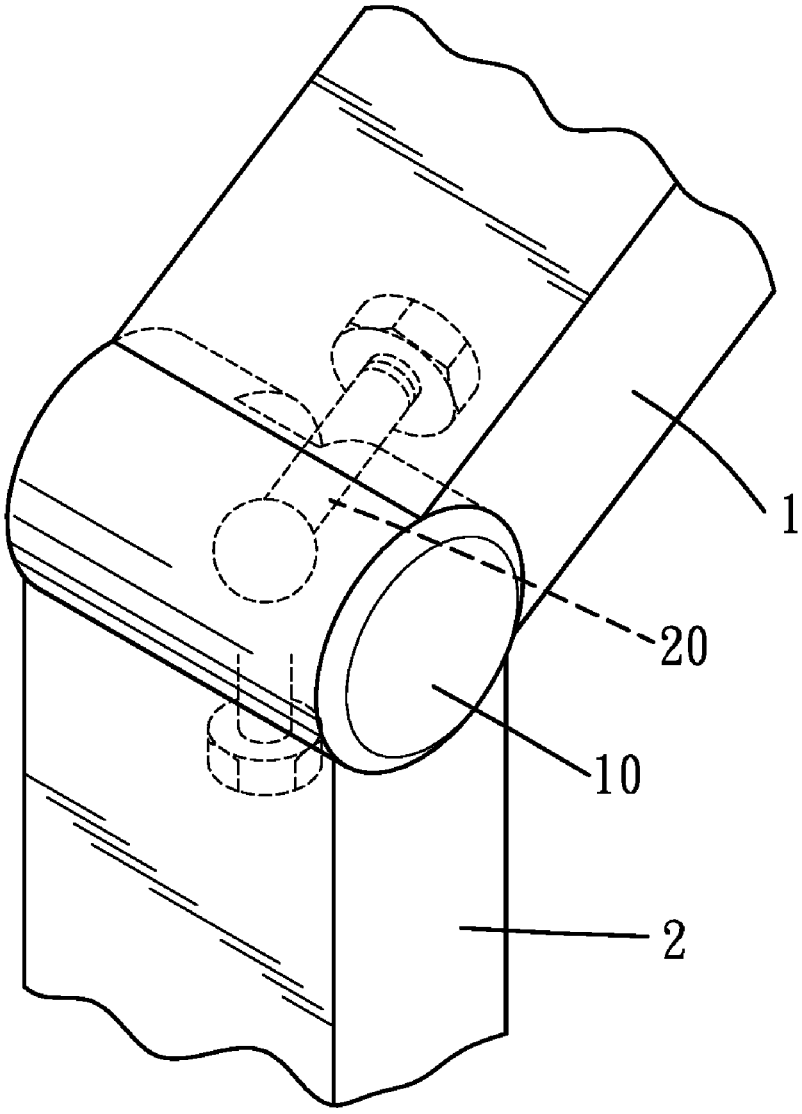
FIG. 5 is a combination drawing showing a joint and rail bodies of the present invention.

Further refer to FIG. 3 to FIG. 5. The first and second rail bodies 1, 2 have concaved first and second rail joint surface 4, 5 respectively, and the joint 10 also has an arc joint surface 11, which is defined around the annular periphery of the joint 10. The joint surface 11 can be engaged with the first and second rail joint surfaces 4, 5. In addition, the cylindrical joint 10 further has a central axis L, a pivot portion 12 through which the central axis L passes, and a longitudinal slot 13 radially disposed from the pivot portion 12 to the joint surface 11 of the joint 10.

The first connecting element 20 is disposed in the longitudinal slot 13, and it has a pivot end 22 pivotably disposed in the pivot portion 12 and a connecting end 21 fixed on the first rail body 1.

Figure 6:
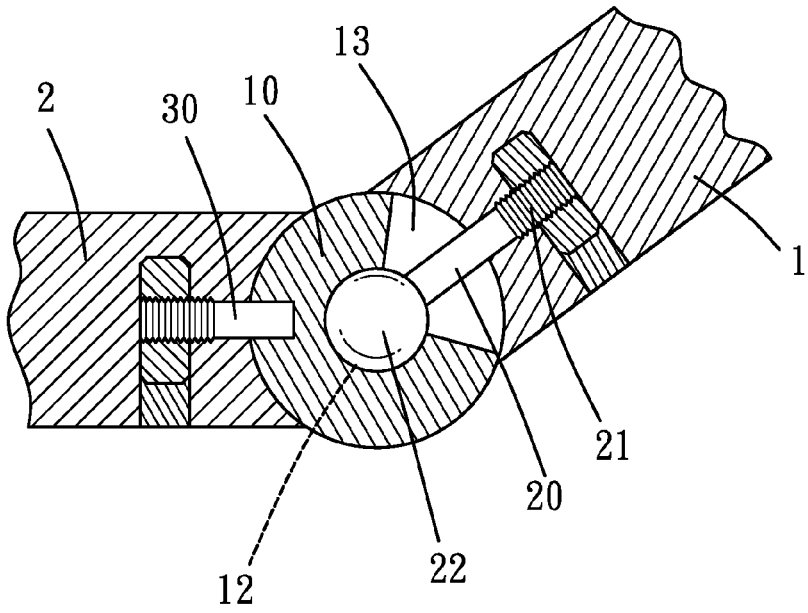
FIG. 6 and FIG. 7 are profiles showing a joint and rail bodies of the present invention.
Figure 7:
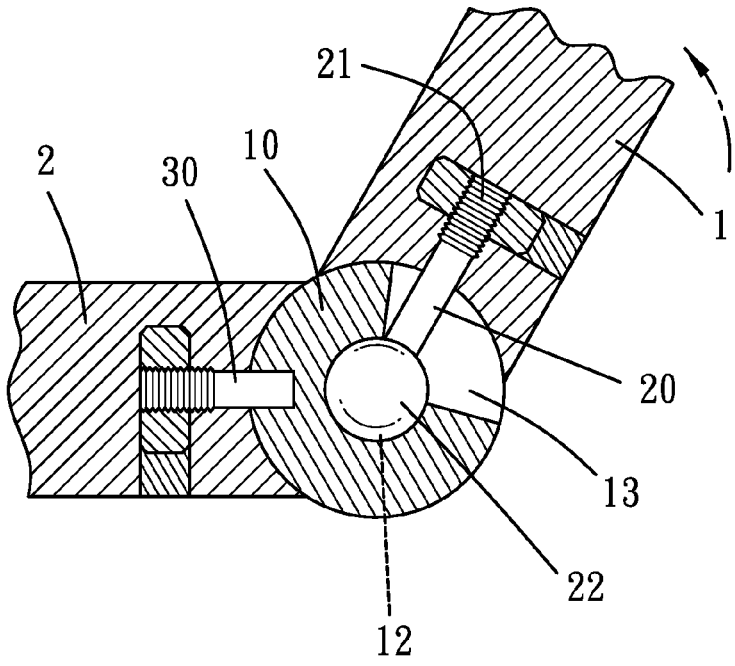

Refer to FIG. 6 and FIG. 7. In the present embodiment, the pivot portion 12 is a spherical chamber, and the pivot end 22 is thus designed to be a sphere. Therefore, the first connecting element 20 is rotatable about its pivot end 22, while the pivot angle is limited by the longitudinal slot 13 having a substantially fan-shaped profile. Because the connecting end 21 of the first connecting element 20 is fixed on the first rail body 1, the first rail body 1 is also rotatable about the central axis L. It is to be noted that the interface between the first rail body 1 and the joint 10 is arc-shaped to enable the relative rotation of said two parts. Moreover, the first rail body 1 has a hole for the connecting end 21 to insert therein and a chamber disposed on a bottom surface thereof. A screw nut can be installed in the chamber to mount the connecting end 21. If necessary, the chamber can be stuffed with appropriate material to flush with the bottom surface of the first rail body 1. The threaded means including the threaded connecting end 21 and the screw nut is only one of many possible fixation means to connect the first connecting element 20 and the first rail body 1. The spherical type of pivot end 22 and pivot portion 12 of the present embodiment is only one of many possible methods to pivot the first connecting element 20 to the joint 10. For example, the pivot end 22 may has an axial bore instead, and a bolt or the like may be disposed in the pivot portion 12 to pivot with the pivot end 22.

The second connecting element 30 connects between the second rail body 2 and the joint 10. Because the first rail body 1 is rotatable about the joint 10, the second rail body 2 is stationary with respect to the joint 10, and the second connecting element can be simply fixed on the joint 10 by threaded means or other fixation means. What's more, the second rail body 2 can be integrally formed with the joint 10. Of course, the second rail body 2 can also pivot to the joint 10 if necessary.

To make the stairway handrail look more integral, the first, second rail bodies 1. 2 and the joint 10 can be made of the same material which selects from the group consisting of synthetic wood, metal and plastic to look natural and continuous, thus the users will not specifically notice the joint 10 and have odd feelings.

The connecting member 40 has a bore 41 for a part of the stanchion to be received therein and a connecting portion 42 to connect to the rail body, or the connecting member 40 can be integrally formed with one of the rail bodies. In the present embodiment, the bore 41 vertically penetrates the connecting member 40 for the stanchion to pierce therethrough, and the bore 41' is disposed on a bottom surface of the connecting member 40' in a non-penetrating manner to receive the top of the stanchion 3. Furthermore, the connecting member 40 can have two bores disposed on opposite surfaces thereof in a non-penetrating manner to joint with two stanchions on both sides thereof.

In the present embodiment, the stanchion and the bore have cylindrical peripheries, thus the connecting member 40 is horizontally rotatable about the stanchion to facilitate the construction process. Of course, the stanchion and the bore can be formed in other shapes which correspond to each other.

Based on the disclosure hereinabove, it is readily understood that the rail bodies of the stairway handrail of the present invention are angle adjustable to facilitate the construction process, that the pivot portion and the pivot end are not exposed to the surroundings once they are assembled, and that the cylindrical shape of the joint can flush with the first and second rail bodies to make the whole set of stairway handrail look more natural and continuous. That is, at the meanwhile the construction process is simplified, the quality of the stairway handrail is not sacrificed but elevated, which meets the requirements of both the constructor and the users.

What is claimed is:

1. A stairway handrail, comprising:

a first rail body, having a concaved first rail joint surface;

a second rail body, having a concaved second rail joint surface;

a substantially cylindrical joint, having an arc joint surface to engaged with the first and second rail joint surfaces, the cylindrical joint further having an central axis, a pivot portion through which the central axis passes, and a longitudinal slot radially disposed from the pivot portion to the joint surface of the joint; and a first connecting element, disposed in the longitudinal slot, the first connecting element having a pivot end pivotably disposed in the pivot portion, and having a connecting end fixed on the first rail body;

wherein, the first rail body is rotatable about the central axis of the joint.

2. The stairway handrail of claim 1, wherein the second rail body is stationary with respect to the joint.

3. The stairway handrail of claim 2, wherein the second rail body is integrally formed with the joint.

4. The stairway handrail of claim 2, further comprising a second connecting element, which connects between the second rail body and the joint.

5. The stairway handrail of claim 1, wherein the first, second rail bodies and the joint are made of the same material which is selected from the group consisting of synthetic wood, metal and plastic.

6. The stairway handrail of claim 1, further comprising multiple stanchions and a connecting member which connects to a rail body, the connecting member having at least one bore for a part of the stanchion to be received therein.

7. The stairway handrail of claim 6, wherein the bore vertically penetrates the connecting member.

8. The stairway handrail of claim 6, wherein the bore is disposed on one surface of the connecting member in a non-penetrating manner.

9. The stairway handrail of claim 6, wherein two of said bores are disposed on opposite surfaces of the connecting member in a non-penetrating manner.

* * * * *